United States Patent [19]

Nattrass

[11] 4,307,764

[45] Dec. 29, 1981

[54] BULK MATERIAL TRANSPORT BAG

[75] Inventor: Peter J. Nattrass, Fox River Grove, Ill.

[73] Assignee: Bulk Lift International Incorporated, Des Plaines, Ill.

[21] Appl. No.: 159,833

[22] Filed: Jun. 16, 1980

[51] Int. Cl.[3] ..... B65D 33/02

[52] U.S. Cl. ..... 150/1; 150/12

[58] Field of Search ..... 150/1, 12; 229/54 R

[56] References Cited

U.S. PATENT DOCUMENTS

| | | | |
|---|---|---|---|
| 4,010,784 | 3/1977 | Nattrass et al. | 150/12 X |
| 4,207,937 | 6/1980 | Sandeman | 150/12 X |

FOREIGN PATENT DOCUMENTS

| | | | |
|---|---|---|---|
| 1696 | 5/1979 | European Pat. Off. | 150/1 |
| 7809415 | 8/1979 | Netherlands | 150/1 |

*Primary Examiner*—Donald F. Norton

*Attorney, Agent, or Firm*—Kinzer, Plyer, Dorn & McEachran

[57] ABSTRACT

A fabric bag for transporting bulk materials, especially granular materials, comprising four generally rectangular side walls, joined to and extending upwardly from a generally rectangular bottom wall; each side wall is joined to the adjacent side walls by a seam which includes two pleats formed inwardly of the side wall edges, the pleats being sewn together, leaving a terminal strip projecting into the bag interior. A lifting loop is located at the top of each seam; a terminal strip is folded over each lifting loop, the seam pleat is folded against one of the side walls, and the pleats, loop legs, terminal strips and side walls are fastened to one another by zig-zag anchor stitching extending from the tops of the walls at least to the bottoms of the lifting loop legs. Preferably, the bottom wall and two of the side walls are formed of a single U-shaped piece of material and the bottom wall is attached to the other two side walls of the bags by seams that are continuous with the side wall seams.

7 Claims, 4 Drawing Figures

BULK MATERIAL TRANSPORT BAG

BACKGROUND OF THE INVENTION

The use of large fabric bags for transporting bulk quantities of powdered or granular material, bags which can be lifted by material handling equipment having hooks or tines, is well known in the art. Bags of this type are shown in U.S. Pat. Nos. 3,961,655 and 4,010,784 issued to Frank Nattrass and Peter Johnson Nattrass. The bags shown in these patents each have four lifting loops attached to the top of the bag by gathering or bunching the bag fabric at each of four spaced locations. Each leg of a loop is secured to the fabric of the bag by folding a section of the fabric to a substantially S-shaped configuration extending from the top toward the bottom of the bag to form three overlying thicknesses of fabric and the leg in inserted between two of the three fabric layers. The resulting assembly is stitched together to anchor the loop to the bag. This construction, while strong and commercially successful, has the disadvantage that the top of the bag is smaller than the cross sectional area of the lower portion of the bag, which may inhibit filling of the bag and reduces the overall capacity.

SUMMARY OF THE INVENTION

It is an object of the present invention, therefore, to provide a bag for transporting bulk material having an open top of approximately the same cross sectional area as the lower part of the bag and which is sufficiently strong to carry heavy loads of powdered or granulated material.

Another object of this invention is to provide a bag for bulk materials having lifting loops securely anchored to each corner of the bag in a manner that affords maximum strength and durability.

Another object of this invention is to provide a bag for bulk material which has a generally constant rectangular cross section throughout its height.

Another object of this invention is to provide a bag for bulk material which has strengthening seams at each vertical corner.

Another object of this invention is to provide a bag for bulk material having a body formed of a minimum number of pieces of fabric.

Accordingly, the invention relates to a bag for transporting bulk materials, of the kind comprising at least four generally rectangular side walls joined to and extending upwardly from a bottom wall, all formed of a woven fabric, the bag having an open top and a plurality of lifting loops each including a bight portion and two legs, with the loop legs secured to the bag at its top. The improved construction comprises at least four side wall seams joining the side walls of the bag, each seam including two pleats, each pleat formed inwardly of a side edge of one of two adjacent side walls, the pleats being sewn together throughout approximately the height of the bag to form the seam, with a terminal strip of each side wall projecting from each seam into the interior of the bag, each terminal strip being wider than the leg portion of a lifting loop. Each lifting leg is secured to a corner of the bag by folding the top portion of each of the two terminal strips at that corner over a substantial length of one leg of the lifting loop and anchor stitching each terminal strip to the adjacent portion of its side wall, through the covered leg portion of the lifting loop, with the anchor stitching extending from the top of the bag at least to the bottom of the lifting loop leg in each instance. The seam pleats are folded against one side wall of the bag, at each top corner where a lifting loop is mounted, and the anchor stitching for the lifting loops also extends through the folded pleats.

BRIEF DESCRIPTION OF THE DRAWINGS

The invention is illustrated more or less diagrammatically in the accompanying drawing, wherein.

DESCRIPTION OF THE PREFERRED EMBODIMENT

Figure 1:
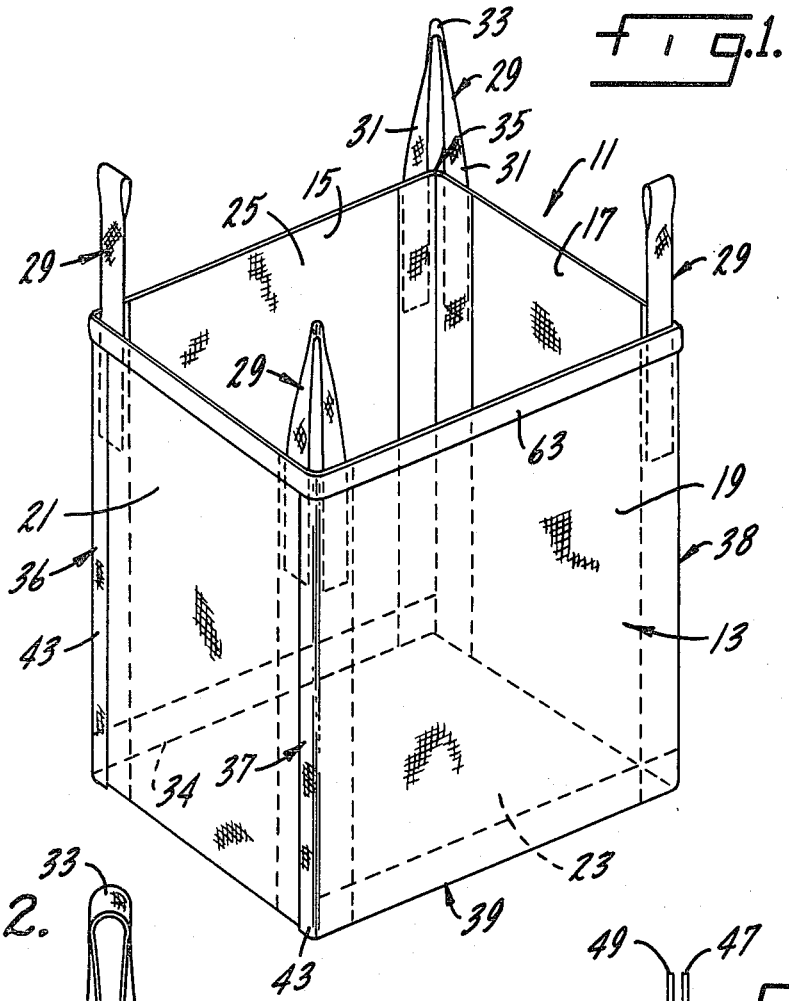
FIG. 1 is a perspective view of a bag embodying the novel features of this invention.

FIG. 1 of the drawings shows a bag 11 constructed in accordance with a preferred embodiment of the invention. The bag 11 includes a body portion 13 of generally rectangular horizontal cross section having four side walls 15, 17, 19 and 21 and a bottom wall 23, all formed of a high tensile strength woven fabric. Each wall is rectangular in shape and is connected to all adjacent walls to form a body of essentially constant cross section from the bottom wall 23 to the open top 25.

A lifting loop 29 is installed in each top corner of the bag 11. Each lifting loop is a length of strong fabric webbing that affords a pair of legs 31 joined by a bight portion 33. The lower ends of the legs 31 are attached to the side walls of the bag body as described below.

Vertically extending seams 35,36, 37 and 38 are formed at the four vertical corners of the bag body. Two horizontally extending seams 34 and 39 are formed at opposite sides of the bottom wall, in this embodiment, at the juncture of the side walls 15 and 19 with the bottom wall 23. The seams 34–39 are all substantially the same in construction; indeed, the seams 37, 38 and 39 are continuous, as are the seams 34, 35 and 36.

Figure 2:
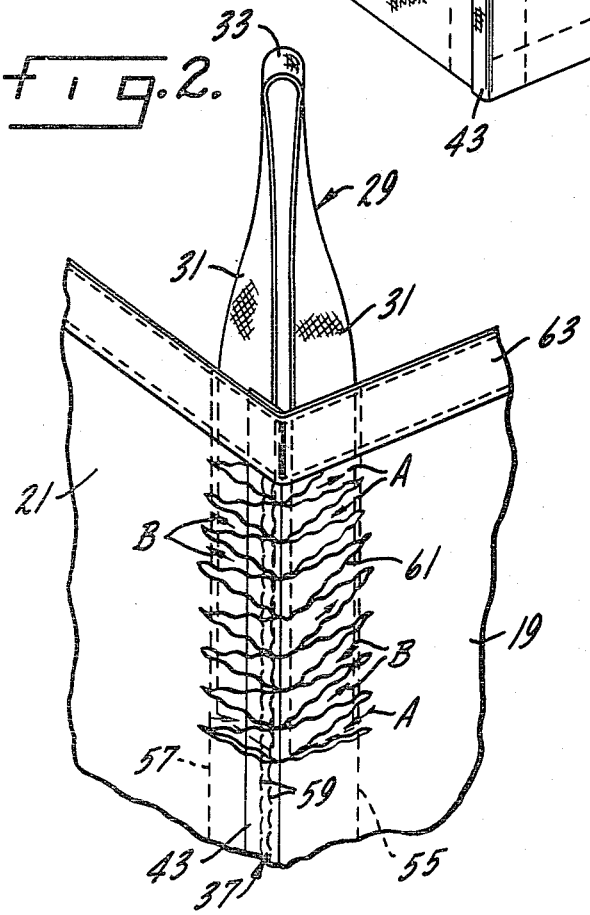
FIG. 2 is an enlarged partial perspective view of one corner of the bag of FIG. 1.
Figure 3:
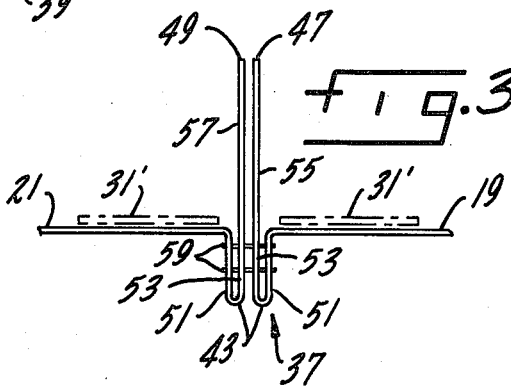
FIG. 3 is an enlarged, exploded top plan view of the first step in the manufacture of a seam.
Figure 4:
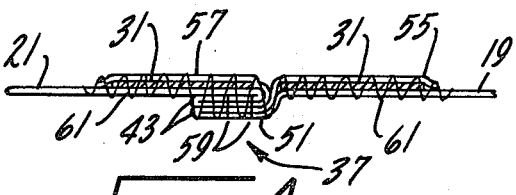
FIG. 4 is an enlarged cross-sectional view showing the attachment of the loop legs in a seam.

The seam construction, using seam 37 as an example, is shown in greater detail in FIGS. 2, 3 and 4. FIG. 3 of the drawings is a somewhat exploded view showing the first step in forming the seam 37. In constructing the seam 37, a pleat 43 is formed in each of the side walls 19 and 21 at a location inwardly from the side edges 47 and 49 of the two walls. Preferably, the edges 47 and 49 are selvage edges to preclude unravelling of the fabric of the walls. Each pleat 43 includes a double thickness of material 51 and 53. Each of the side wall elements 53 extends into the interior of the bag, providing two terminal strips 55 and 57. The pleats 43 are sewn together by stitches 59 in the manner shown in FIG. 3 of the drawings. One or two rows of seam stitching 59 are usually sufficient, two rows being shown in the drawings. The seam stitching 59 may be of the chain type for strength and to prevent unravelling.

The legs 31 of a lifting loop 29 are then positioned against the top portions of the side walls 19 and 21, on the opposite sides of each wall from the pleats (the inside of the bag), as generally indicated by the phantom outlines 31' in FIG. 3. The terminal strips 55 and 57 are then folded against their respective side walls 19 and 21 and over the lifting loop legs 31 in the manner shown in FIG. 4. The pleats 43 are folded against one of the walls, in this case the side wall 21. The terminal strips 55 and 57, the loop legs 31, the walls 19 and 21, and the pleats 43 are then all stitched together by anchor stitching 61 to fasten the lifting loop to the top corner of the bag (FIGS. 2 and 4). The stitching 61 is preferably applied in a double zig-zag manner as shown in FIG. 2 of the drawings with the stitching having both horizontal and diagonal components in order to engage more fibers of the bag. As an example, the anchor stitching 61 for each lifting loop 29 may consist of about 15 transverse passes zig-zagging downwardly, in the direction of the arrows A, and a corresponding number of transverse passes zig-zagging upwardly as indicated by arrows B in FIG. 2. The anchor stitching 61, in a typical bag, may have a total height of about eight inches, and a total length of stitching of about 150 inches. In the drawings, the anchor stitching 61 is shown as having a horizontal zig-zag configuration; a vertical zig-zag pattern can also be effectively employed.

In the illustrated embodiment, the seams are so constructed that the pleats 43 are located on the exterior of the bag body, and the webbing that comprises the lifting loop legs 31 is positioned inside the bag. This relationship can be reversed with no loss of strength. However, the illustrated construction is preferred for cosmetic reasons and to avoid snagging of the terminal strips 55 and 57 on external objects during the use of the bag. A binding 63 is preferably provided at the open top of the container, sewn to the exterior surfaces of the side walls 15, 17, 19 and 21.

All seams are formed in the same manner as described for the seam 37. However, the seam pleats 43 are folded against the bag walls only in those areas where lifting loops are mounted on the bag. The anchor stitching 61 can be continued down the corners of the bag, well beyond the bottoms of the loop legs 31, if desired, for added overall strength.

The side walls 17 and 21 and the bottom wall 23 are preferably formed of a single piece of material which is attached to the side walls 15 and 19, side walls 15 and 19 each comprising a separate piece of fabric. Therefore, the body of the bag contains only three separate pieces of material, other than the lifting loops and the binding. This allows for complete construction with just two continuous seams 34–36 and 37–39, holding fabrication costs to a minimum, and also affords maximum strength for the bag.

The body 13 of the bag 11 may be made from any suitable material; preferably, it is woven from a high tensile strength synthetic fiber, for example, polypropylene, polyethylene terephthalate, rayon, nylon and mixtures thereof as well as natural fibers such as jute. However, synthetic fibers are stronger and more resistant to deterioration and therefore are preferred. The material used for the lifting loops 29 is preferably woven webbing of the type used for vehicle seat belts. This material is frequently polyethylene terephthalate sold under the trademark TERYLENE. However, it should be understood that the invention is not limited to the materials described and other suitable materials may be used.

Using the particular construction shown in FIGS. 1–4, bulk transport bags have been fabricated that are capable of surviving a 2000 lb. drop test from a height of three feet. To achieve this capability, the bag fabric should have a strength of at least 400 lbs./inch vertically and 300 lbs./inch horizontally; the webbing used for the lifting loops 29 should have a minimum strength of 6000 lbs. with a width of at least two inches, and the terminal strips 55 and 57 should be no less than 2.5 inches in width.

I claim:

1. In a bag for transporting bulk materials, of the kind comprising at least four generally rectangular side walls joined to and extending upwardly from a bottom wall, all formed of a woven fabric, the bag having an open top and a plurality of lifting loops each including a bight portion and two legs, with the loop legs secured to the bag at its top, the improved construction comprising:

at least four side wall seams joining the side walls of the bag, each seam including two pleats, each pleat formed inwardly of a side edge of one of two adjacent side walls, the pleats being sewn together throughout approximately the height of the bag to form the seam, with a terminal strip of each side wall projecting from each seam, each terminal strip being wider than the leg portion of a lifting loop;

each lifting loop being secured to a corner of the bag by folding the top portion of each of the two terminal strips at that corner over a substantial length of one leg of the lifting loop and anchor stitching each terminal strip to the adjacent portion of its side wall, through the covered leg portion of the lifting loop, with the anchor stitching extending from the top of the bag at least to the bottom of the lifting loop leg in each instance;

the seam pleats being folded against one side wall of the bag, at each top corner where a lifting loop is mounted, and the anchor stitching for the lifting loops also extending through the folded pleats.

2. A bulk material bag according to claim 1 in which the anchor stitching forms a zig-zag pattern wide enough to encompass approximately the full width of both lifting loop legs.

3. A bulk material bag according to claim 1 in which the anchor stitching forms a double zig-zag pattern, down from the bag top to the bottom of the lifting loop legs and back up again, and the pattern is wide enough to encompass approximately the full width of both lifting loop legs.

4. A bulk material bag according to claim 1, claim 2, or claim 3 in which the terminal strips and the lifting loop are positioned in the interior of the bag and the pleats are located on the exterior of the bag.

5. A bulk material bag according to claim 1, claim 2, or claim 3, in which the bag is of rectangular configuration having four side walls, with two of the side walls and the bottom wall being formed from a continuous piece of material, and with the other two side walls comprising separate pieces joined to the bottom wall by seams corresponding in construction to the seams joining adjacent side walls, and in which the sewing for each seam extends from the top of the bag down one corner, across one side of the bottom wall of the bag, and back up one corner to the top of the bag.

6. A bulk material bag according to claim 5 in which all of the pieces constituting the body of the bag have cut edges only at the tops of all of the side walls and at the bottoms of said other two side walls, and selvage edges elsewhere.

7. A bulk material bag according to claim 5 in which the terminal strips and the lifting loop are positioned in the interior of the bag and the pleats are located on the exterior of the bag.

* * * * *

REEXAMINATION CERTIFICATE (589th)

United States Patent [19]

Nattrass

[11] B1 4,307,764

[45] Certificate Issued Nov. 4, 1986

[54] BULK MATERIAL TRANSPORT BAG

[75] Inventor: Peter J. Nattrass, Fox River Grove, Ill.

[73] Assignee: Bulk Lift International Incorporated, Des Plaines, Ill.

Reexamination Reqs:st:
No. 90/000,585, Jul. 6, 1984
No. 90/000,734, Mar. 8, 1985

Reexamination Certificate for:

| | |
|---|---|
| Patent No.: | **4,307,764** |
| Issued: | **Dec. 29, 1981** |
| Appl. No.: | **159,833** |
| Filed: | **Jun. 16, 1980** |

[51] Int. Cl.[4] ..... B65D 33/02
[52] U.S. Cl. ..... 383/17; 383/22
[58] Field of Search ..... 383/6, 20, 24, 107, 383/17, 22

[56] References Cited

U.S. PATENT DOCUMENTS

| | | | |
|---|---|---|---|
| 2,095,886 | 10/1937 | Neuman . | |
| 3,961,655 | 6/1976 | Nattrass et al. | 383/24 |
| 4,010,784 | 3/1977 | Nattrass et al. | 383/24 X |
| 4,207,937 | 6/1980 | Sandeman | 383/24 X |
| 4,224,970 | 9/1980 | Williamson et al. | 383/24 X |
| 4,301,848 | 11/1981 | Beaven et al. | 383/24 X |

FOREIGN PATENT DOCUMENTS

| | | | |
|---|---|---|---|
| 1691 | 5/1979 | European Pat. Off. | 383/17 |
| 1696 | 5/1979 | European Pat. Off. | 383/17 |
| 7809415 | 8/1979 | Netherlands | 383/6 |
| 1591866 | 6/1981 | United Kingdom . | |

OTHER PUBLICATIONS

Sales Brochure entitled "Bulk Lift Semi-Bulk Containers" (1978) and photocopies of actual Bulk Lift Containers.

Lolift Ltd. Advertisement, "Bulk Storage Movement Control", Sep./Oct. 1977, May/Jun. 1979.

*Primary Examiner*—William I. Price

[57] ABSTRACT

A fabric bag for transporting bulk materials, especially granular materials, comprising four generally rectangular side walls, joined to and extending upwardly from a generally rectangular bottom wall; each side wall is joined to the adjacent side walls by a seam which includes two pleats formed inwardly of the side wall edges, the pleats being sewn together, leaving a terminal strip projecting into the bag interior. A lifting loop is located at the top of each seam; a terminal strip is folded over each lifting loop, the seam pleat is folded against one of the side walls, and the pleats, loop legs, terminal strips and side walls are fastened to one another by zig-zag anchor stitching extending from the tops of the walls at least to the bottoms of the lifting loop legs. Preferably, the bottom wall and two of the side walls are formed of a single U-shaped piece of material and the bottom wall is attached to the other two side walls of the bags by seams that are continuous with the side wall seams.

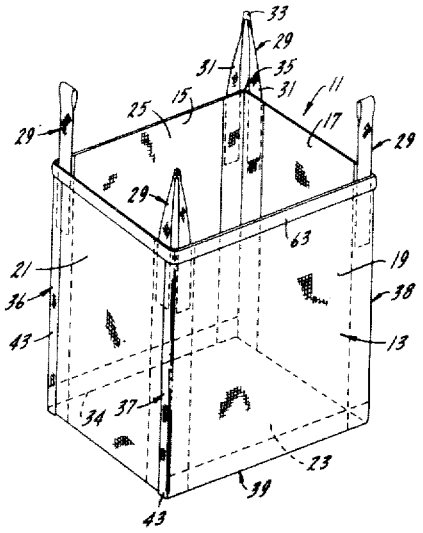

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *